US009667039B2

(12) United States Patent
Gan et al.

(10) Patent No.: US 9,667,039 B2
(45) Date of Patent: May 30, 2017

(54) DEVICE AND METHOD FOR INJECTING IONS INTO A STREAM OF AIR

(71) Applicant: V.S. Industry Berhad, Johor (MY)

(72) Inventors: Sem Yam Gan, Malaysia (MY); Choon Meng Teo, Malaysia (MY)

(73) Assignee: NATURION PTE. LTD, Bukit Merah Central (SG)

( * ) Notice: Subject to any disclaimer, the term of this patent is extended or adjusted under 35 U.S.C. 154(b) by 57 days.

(21) Appl. No.: 14/747,095

(22) Filed: Jun. 23, 2015

(65) Prior Publication Data

US 2016/0197457 A1 Jul. 7, 2016

(30) Foreign Application Priority Data

Jan. 2, 2015 (SG) ..... 10201500012R

(51) Int. Cl.
*H01T 23/00* (2006.01)

(52) U.S. Cl.
CPC ..... *H01T 23/00* (2013.01)

(58) Field of Classification Search
CPC ..... H01T 23/00; H01L 2924/0002
USPC ..... 361/231
See application file for complete search history.

(56) References Cited

U.S. PATENT DOCUMENTS 3,943,407 A 3/1976 Bolasny
4,783,716 A 11/1988 Nagase et al.
5,973,905 A 10/1999 Shaw
9,421,219 B2 * 8/2016 Tachibe ..... A61K 31/718
2003/0098650 A1 * 5/2003 Adachi ..... H01T 23/00 313/587
2013/0189129 A1 * 7/2013 Genereux ..... F04D 29/666 417/313
2014/0003994 A1 1/2014 Takenoshita et al.

FOREIGN PATENT DOCUMENTS

JP 2003036954 A 2/2003
JP 2004363088 A 12/2004
KR 20110085607 A 7/2011

OTHER PUBLICATIONS

Libor Stichauer, Extended European Search Report, 9 pages, May 25, 2016, The Hague.
Sung Gon Kim, International Search Report, Apr. 19, 2016, 3 pages, Korean Intellectual Property Office, Republic of Korea.

* cited by examiner

*Primary Examiner* — Dharti Patel
(74) *Attorney, Agent, or Firm* — McGarry Bair PC

(57) ABSTRACT

A device and method for injecting ions into a stream of air. The device comprises a housing; an electric circuit inside the housing; an electrically conductive element coupled to the electric circuit for emitting ions, at least a portion of the conductive element being exposable to at least a portion, of the stream of air for injecting the ions into the stream of air; and a heater element disposed inside the housing for heating one or more circuit elements of the electric circuit.

24 Claims, 7 Drawing Sheets

- 502 -

DEVICE AND METHOD FOR INJECTING IONS INTO A STREAM OF AIR

CROSS-REFERENCE TO RELATED APPLICATIONS

This application claims the benefit of Singapore Patent Application No. 10201500012R, filed Jan. 2, 2015, which is incorporated herein by reference in its entirety.

BACKGROUND OF THE INVENTION

Field of the Invention

The present invention relates broadly to a device and method for injecting ions into a stream of air, in particular negative ions.

Description of the Related Art

Ionizers, for example air ionizers, may be used to release negative ions to the air, which may provide positive effects to humans exposed to the air with negative ions.

U.S. Pat. No. 3,943,407 discloses an ion generator that has a heating element to heat a stream of gas during its passage through an ionizer chamber to increase ionization.

U.S. Pat. No. 4,783,716 discloses an ion generator with a resistor heating element used to heat the exposed surface of a dielectric member for the production of ions, so as to remove adsorbed substances such as moisture on the exposed surface.

Embodiments of the present invention, seek to provide at least an alternative solution for providing a stable production of ions.

SUMMARY OF THE INVENTION

In accordance with a first aspect of the present invention, there is provided a device for injecting ions into a stream of air, comprising a housing; an electric circuit inside the housing; an electrically conductive element coupled to the electric circuit for emitting ions, at least a portion of the conductive element being exposable to at least a portion of the stream of air for injecting the ions into the stream of air; and a heater element disposed inside the housing for heating one or more circuit elements of the electric circuit.

In accordance with a second aspect of the present invention, there is provided method of injecting ions into a stream of air, comprising providing a housing providing an electric circuit inside the housing; providing an electrically conductive element coupled to the electric circuit for emitting ions, at least a portion of the conductive element being exposable to at least a portion of the stream of air for injecting the ions into the stream of air; and disposing a heater element inside the housing for heating one or more circuit elements of the electric circuit.

BRIEF DESCRIPTION OF THE DRAWINGS

Embodiments of the invention will be better understood and readily apparent to one of ordinary skill in the art from the following written descriptions by way of example only, and in conjunction with the drawings, in which.

DESCRIPTION OF THE PREFERRED EMBODIMENT

Embodiments of the present invention relate to a device and method for injecting ions into a stream of air for providing a stable production of ions.

Figure 1A:
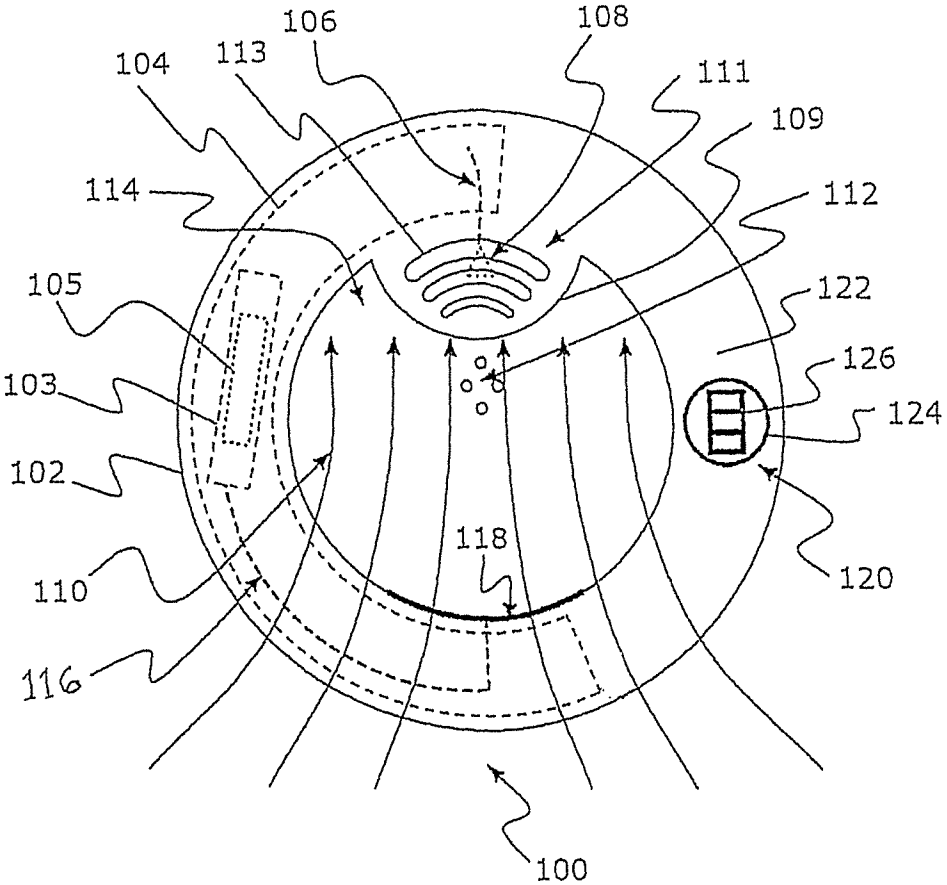
FIG. 1*a*) shows a schematic drawing of a device for injecting ions into a stream of air according to an example embodiment.

FIG. 1*a*) shows a device 100 for injecting ions into a stream of air 110 according to an example embodiment. The device comprises a substantially ring-shaped housing 102. An electric circuit board 104 and a heating element 105 are disposed inside the housing 102.

Figure 1B:
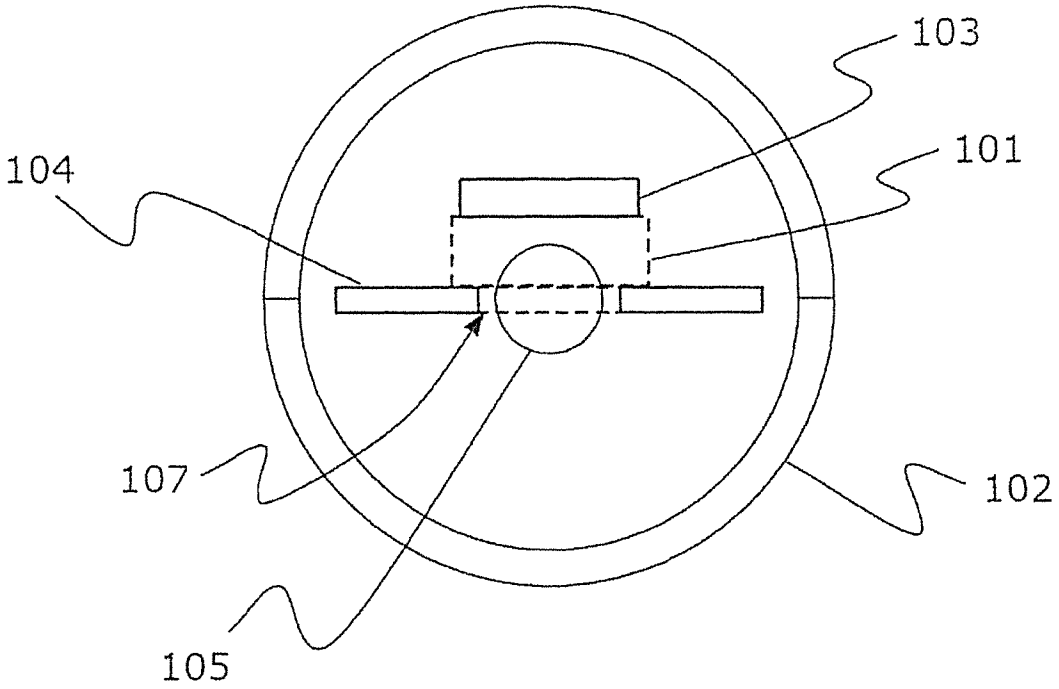
FIG. 1*b*) shows a schematic cross-sectional view of the device of FIG. 1*a*).

FIG. 1*b*) shows a schematic cross-sectional view of the ring-shaped housing 102 in the area of the heating element 105. The heating element 105 is disposed within an opening or slot 107 formed in the circuit board 104. A foam type double skied tape 101 is used to mount the piezo transformer 103 in the area above the heating element 105, for thermal coupling to control the temperature of the piezo transformer 103.

Returning to FIG. 1*a*), an electrically conductive element in the form of a cable or bundle of cables 106, which on one end has or forms a tip portion 108, is coupled to the electric circuit 104 for emitting ions. The tip portion 108 is disposed within a chamber 109 of the housing 102 with a grill-like opening 111 for injecting ions into the stream of air 110. The grill-like opening 111 includes slots e.g. 113 formed in the material of the housing 102 for exposure of the tip portion 108 to at least a portion of the stream of air 110. It will be appreciated that openings of a different design type may be provided for enabling injection of ions into the stream of air 110. In the example embodiment, the grill-like opening 111 is formed on one side of the device 100 which, in use, faces upstream relative to the stream of air 110. It has been found by the inventors that the stream of air 110 may cause a turbulence pattern which facilitates that, in addition to entry of a portion of the stream of air 110 into the chamber 109, air is also drawn out from, the chamber 109 again through the grill-like opening 111, thus facilitating an efficient injection of ions 112 into the stream of air 110.

In this example embodiment, the heater element 105 and the piezo transformer 103 are disposed away from the chamber 109, so as to preferably minimize or prevent heat exchange with the stream of air 110. The tip portion 108 may have one or more fins or one or more cable ends exposed to the stream of air 110, so that ions may be emitted into the stream of air 110 via the one or more fins or one or more cable ends. The fins or cable ends may be made of conductive material. For example a plurality of fins or cable ends, for example 20 fins or cable ends, may be provided. The tip portion 108 with a plurality of fins or cable ends may have the shape of a brush. The plurality of tins or cable ends may be arranged in a formed-out configuration. The tip portion 108 may emit negative ions 112 for injection into the stream of air 110.

As illustrated in FIG. 1, the housing 102 is configured to define a channel for the stream of air, the channel in this embodiment being provided by the hollow center 114 of the substantially ring-shaped housing 102.

An electrode 118 is provided as a counter electrode for the emission of ions from the tip portion 108. The electrode 118 in this embodiment is disposed substantially diametrically opposed to the tip portion 108, and facing towards the hollow center 114. The electrode 118 is electrically connected to the ground pin of the piezo transformer 103, as indicated by the dotted line 316. As will be appreciated by a person skilled in the art, in operation an electric field between the counter electrode 118 and the tip portion 108 facilitates the injection of ions 112 into the stream of air 110.

The device 100 further comprises a coupling element in the form of a clip 120 for coupling the device 100 to an external airflow device (not shown) generating the stream of air. The clip 120 in this embodiment is disposed on a wall 122 of the housing facing in a direction substantially perpendicular to a plane defined by the hollow center 114 of the housing 102 and upstream relative to the stream of air 110. The clip 120 may be attached to, or formed at least in part integrally with, the housing 102. The clip 120 in this embodiment comprises a base portion 124 and a grip portion 126. The grip portion 126 is rotatable relative to the base portion 124, for adjustably coupling the device 100 to the external airflow device.

Figure 2:
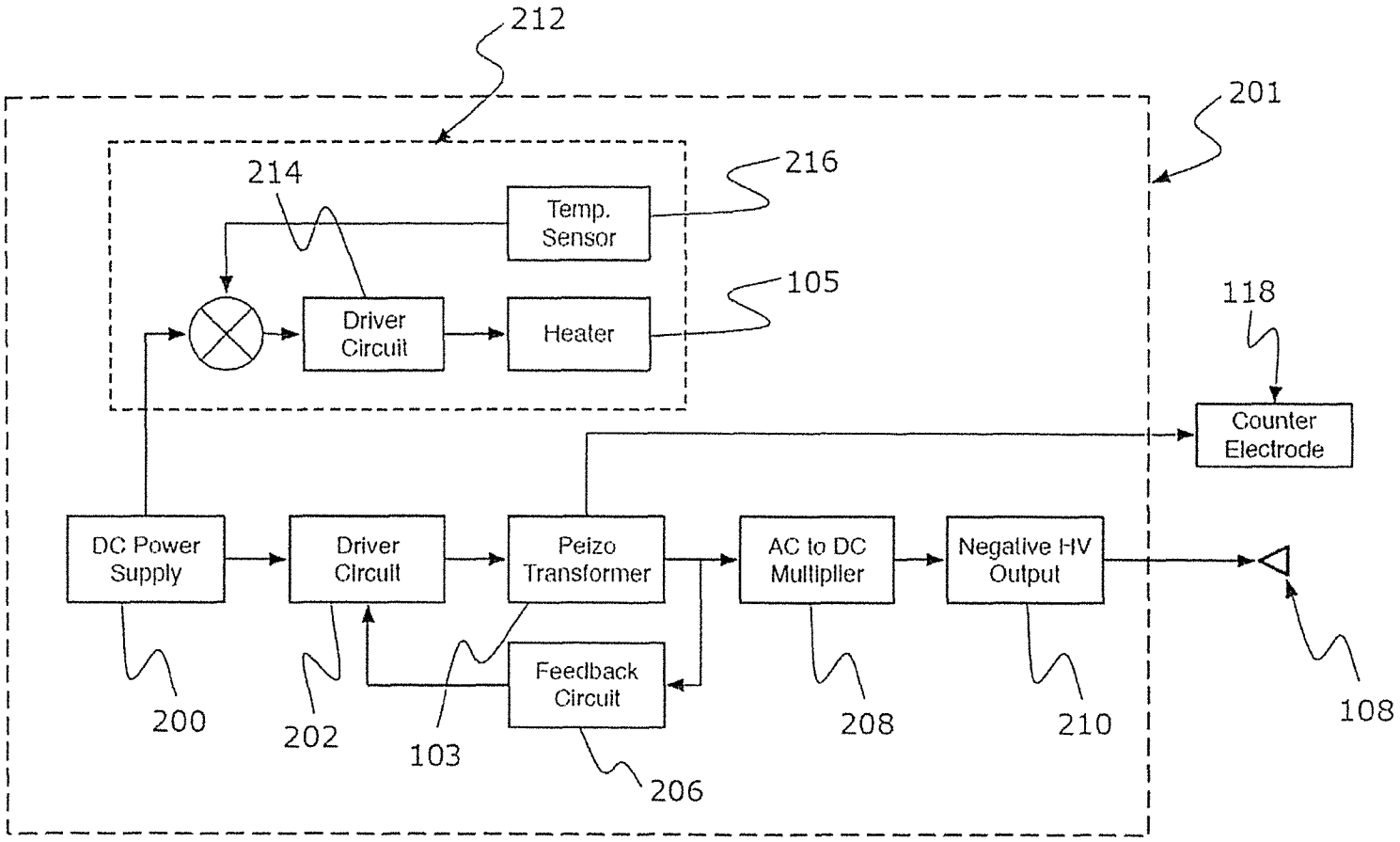
FIG. 2 shows a schematic circuit diagram of an electric circuit disposed inside a housing of the device of FIG. 1.

FIG. 2 shows a schematic circuit diagram of the electric circuit 201 formed on the circuit board 104 disposed inside the housing 102 (FIG. 1). The electric circuit 201 comprises a direct current (DC) power supply 200, for providing an incoming power of about 5 V in this embodiment. The power supply 200 may include or may be a battery and/or a rechargeable battery (for example a car battery) and/or a power generator and/or a photovoltaic cell and/or a fuel cell and/or a hydrogen fuel cell and/or a power plug (for example configured to be coupled, directly or via an intermediate device, to a public power grid or to a localized power grid, for example a low voltage power outlet in a car or automobile).

The electric circuit 201 also comprises a piezo driver circuit 202 for providing a consistent signal to drive the piezo high voltage generator or transformer 103. The piezoelectric transformer 103 can be made from a ceramic material with a high dielectric constant, functioning to generate high voltage. A feedback circuit 206 is provided to maintain the high voltage output at a desired level.

As is understood by a person skilled in the art, a piezo transformer used in the example embodiment is a type of AC voltage multiplier. Unlike a conventional transformer, which uses magnetic coupling between input and output, the piezoelectric transformer uses acoustic coupling. An input voltage applied across a short length of a bar of e.g. piezoceramic material, creating an alternating stress in the bar by the inverse piezoelectric effect and causing the whole bar to vibrate. The vibration frequency is chosen to be the resonant frequency of the block. A higher output voltage is then generated across another section of the bar by the piezoelectric effect. The piezoelectric, effect is understood as the linear electromechanical interaction between the mechanical and the electrical state.

The electric circuit 201 also comprises, an alternating current (AC) to DC multiplier 208 for converting the high AC power from the piezo transformer 103 to a negative DC high voltage (HV). A negative HV output 210 is provided to couple to the electrically conductive element in the form of a cable or bundle of cables 106 (FIG. 1), for injecting the ions into the stream of air 110 (FIG. 1) at the tip portion 108 (FIG. 1).

A heater circuit 212 comprises the heating element 105 for maintaining a desired temperature at/near the piezo transformer 103 in this embodiment, i.e. irrespective of changing environmental temperature to which the device 100 (FIG. 1) is subjected. In one embodiment, the heating element 105 is implemented as a resistive heater and is coupled to a heater driver circuit 214 for controlling the temperature in the resistive heater. The driver circuit 214 may be configured to switch on/off an operation current in the resistive heater based on feedback from a temperature sensor 216, for maintaining a desired operating temperature of one or more of the components of the electric circuit 201 on the circuit board 104 inside the housing 102 (FIG. 1). The temperature sensor 216 can e.g. be implemented as a thermistor acting as a sensor, i.e. having a resistance dependent on the temperature it is subjected to. The temperature sensor 216 provides feedback to the heater driver circuit 214 as described above.

The heater circuit 212 may be coupled to the power supply 200, and/or may be provided with a separate power supply in different embodiments.

In one embodiment, the heating element 105 is located inside the opening 10 of the circuit board 104, compare FIG. 1*b*). Other components of the heater circuit 212 such as the heater driver 214 and the sensor 216 are formed on the circuit board 104, with the sensor 216 located close to the piezo transformer 103.

Figure 3:
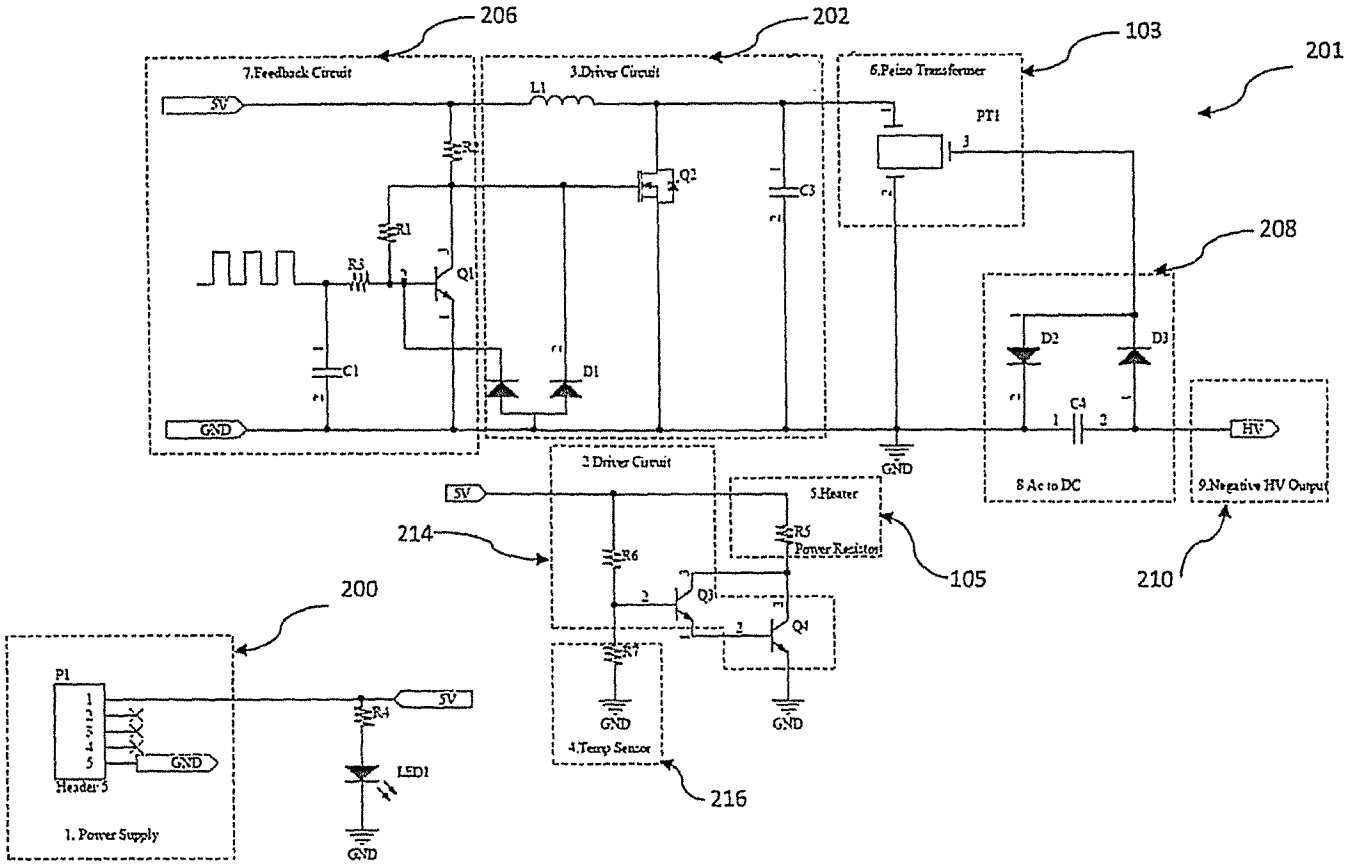
FIG. 3 shows a circuit diagram showing one example implementation of the electric circuit of FIG. 2.

FIG. 3 shows a circuit diagram showing one non-limiting example implementation of the electric circuit 201, with respective circuit, portions for the power supply 200, the piezo driver circuit 202, the piezo transformer 103, the feedback circuit 206, the AC to DC multiplier 208, the negative HV output 210, the heating element 105, the heater driver circuit 214, and the temperature sensor 216, respectively functioning as described above with reference to FIG. 2.

Figure 4:
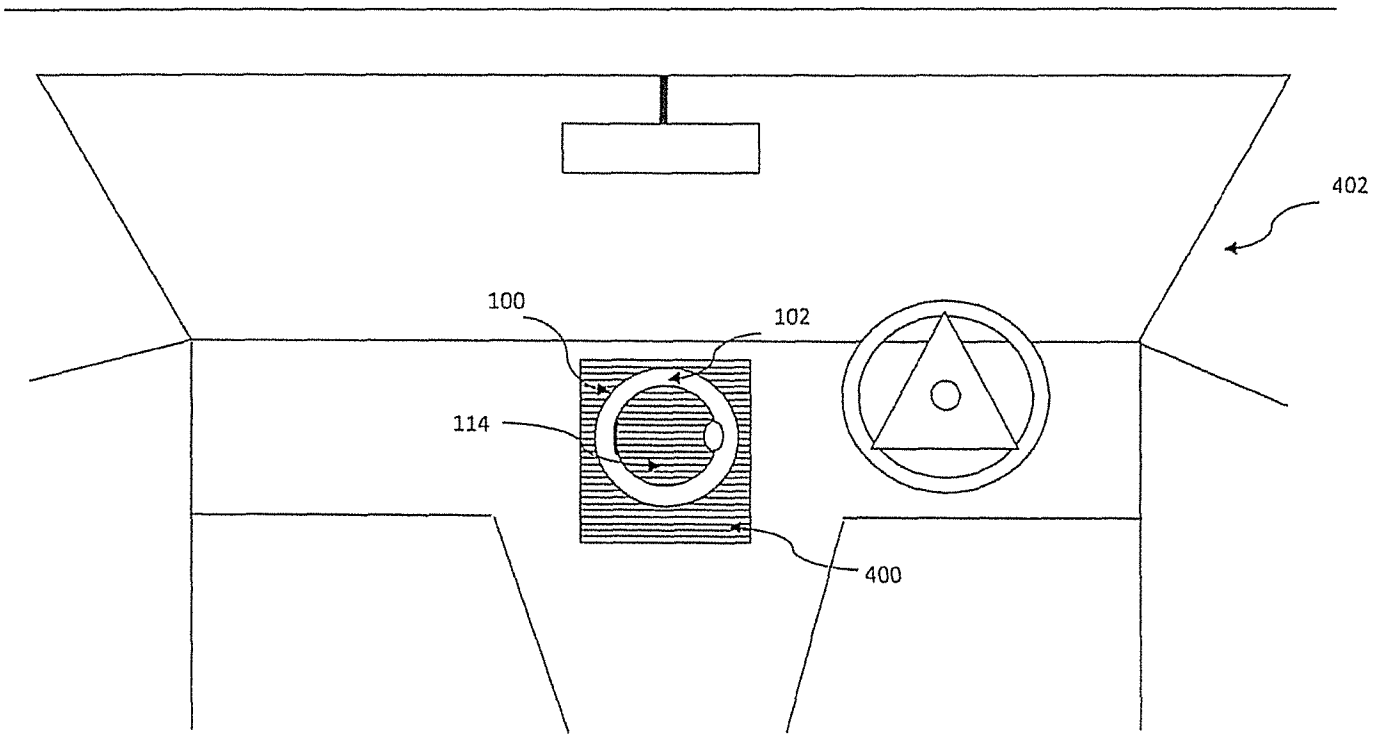
FIG. 4 shows a schematic drawing illustrating an application example of a device according to an example embodiment.

FIG. 4 shows a schematic drawing illustrating one application example of the device 100 according to the example embodiment. The device 100 in this application example is coupled to an outlet 400 of an air-conditioning unit (not shown) of a car 402. The device 100 is adjustably coupled to the outlet 400 by way of the clip (hidden), allowing lateral and rotational movement of the substantially ring-shaped housing 102 so as to dispose the hollow center 114 optimally or in a desired disposition relative to the outlet 400 and/or relative to the interior of the car 402.

The conditioned stream of air from the outlet 400 is directed, at least in part, through the hollow center 114 for injection of negative ions into the conditioned stream. It has been found that the efficiency of the injection of ions may be adversely affected by variations from a desired operation temperature, of one or more of the circuit components of the device 100.

Advantageously, by providing the heater inside the housing 102 and in close proximity/thermal coupling to one or more of the circuit components for controlling the temperature of one or more of the circuit components of the device 100, the temperature of one or more of the circuit components can be controlled without directly affecting the ambient temperature around the device 100, preferably resulting in reduced or substantially no thermal influence on the conditioned stream of air that passes through the hollow center 114 of the device 100 for injection with ions. This can advantageously avoid or reduce adverse effects on e.g. a desired cooling effect of the alt-conditioning unit. The housing 102 may be specifically configured to be thermally insulating, such as by choice of one or more of materials), coating and/or lining layer(s), etc. In the example embodiment, the heater and relevant one or more circuit components are disposed away from the chamber 109 (FIG. 1), so as to preferably further minimize or prevent heat exchange with the stream of air.

As mentioned above, the device 100 is adjustably coupled to the outlet 400 by way of the clip (hidden), allowing lateral, and rotational movement of the substantially ring-shaped housing 102 so as to dispose the hollow center 114 optimally or in a desired disposition relative to the outlet 400 and/or relative to the interior of the car 402. This can advantageously enable easy adjustment for a desired direction and/or strength of the air stream rejected with ions, for example towards one or more of the persons inside the car 402.

Figure 5:
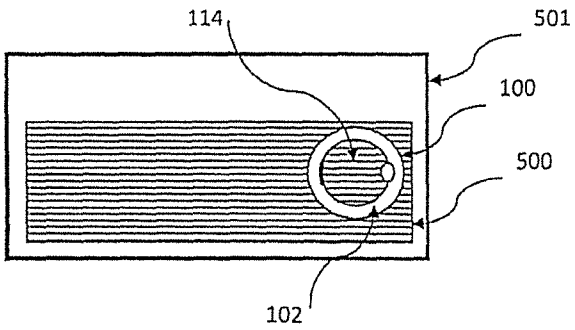
FIG. 5 shows a schematic drawing illustrating another application example of a device according to an example embodiment.

FIG. 5 shows a schematic drawing illustrating another application example of the device 100 according to the example embodiment. The device 100 in this application example is coupled to an outlet 500 of an air-conditioning unit 501 inside a room 502. The device 100 is adjustably coupled to the outlet 500 by way of the clip (hidden), allowing lateral and rotational movement of the substantially ring-shaped housing 102 so as to dispose the hollow center 114 optimally or in a desired disposition relative to the outlet 500 and/or relative to the interior of the room 502.

The conditioned stream of air from the outlet 500 is directed, at least in part, through the hollow center 114 for injection of negative ions into the conditioned stream. As mentioned above, it has been found that the efficiency of the injection of ions may be adversely affected by variations from a desired operation, temperature of one or more of the circuit components of the device 100.

Advantageously, by providing the heater inside the housing 102 and in close proximity/thermal coupling to one or more of the circuit components for controlling the temperature of one or more of the circuit components of the device 100, the temperature of the one or more of the circuit elements can be controlled without directly affecting the ambient temperature around the device 100, preferably resulting in reduced or substantially no thermal influence on the conditioned stream of air that passes through the hollow center 114 of the device 100 for injection with ions. This can advantageously avoid or reduce adverse effects on e.g. a desired cooling effect of the air-conditioning unit. The housing 102 may be specifically configured to be thermally insulating, such as by choice of one or more of material(s) coating and/or lining layer(s). etc. In the example embodiment, the heater and relevant one or more circuit components are disposed away from the chamber 109 (FIG. 1), so as to preferably further minimize or prevent heat exchange with the stream of air.

As mentioned above, the device 100 is adjustably coupled to the outlet 500 by way of the clip (hidden), allowing lateral and rotational movement of the substantially ring-shaped housing 102 so as to dispose the hollow center 114 optimally or in a desired disposition relative to the outlet 500 and/or relative to the interior of the room 502. This can advantageously enable easy adjustment for a desired direction and/or strength of the air stream injected with ions, for example towards one or more of the persons inside the room 502.

In one embodiment, a device for injecting ions into a stream of air comprises a housing: an electric circuit inside the housing; an electrically conductive element coupled to the electric circuit for emitting ions, at least a portion of the conductive element being exposable to at least a portion of the stream of air for injecting the ions into the stream of air; and a heater element disposed inside the housing for heating one or more circuit elements of the electric circuit.

The device may further comprise a temperature sensor disposed inside the housing and configured for sensing a temperature at or near the one or more circuit elements. The device may comprise a feedback circuit for controlling the heater element responsive to the temperature sensed by the temperature sensor.

The housing may be configured to define a channel for the stream of air. The housing may be substantially ring-shaped, wherein the channel is provided by a hollow center portion of the substantially ring-shaped housing. The portion of the conductive element may be disposed inside a chamber of the housing adjacent the channel for injecting the ions into the stream of air. The chamber may comprise an opening for exposure of the portion of the conductive element to the portion of the stream of air.

The one or more circuit elements may comprise a piezo-transformer. The heating element may be disposed in a stacked arrangement with the piezo-transformer.

The device may farther comprise a coupling element for coupling the device to an airflow device for generating the stream of air. The coupling element may be configured for adjustably coupling the device to the airflow device.

The electrically conductive element may be coupled to the electric circuit for emitting negative ions.

The housing may be configured to be thermally insulating, such as by choice of one or more of material(s), coating and/or lining layer(s).

Figure 6:
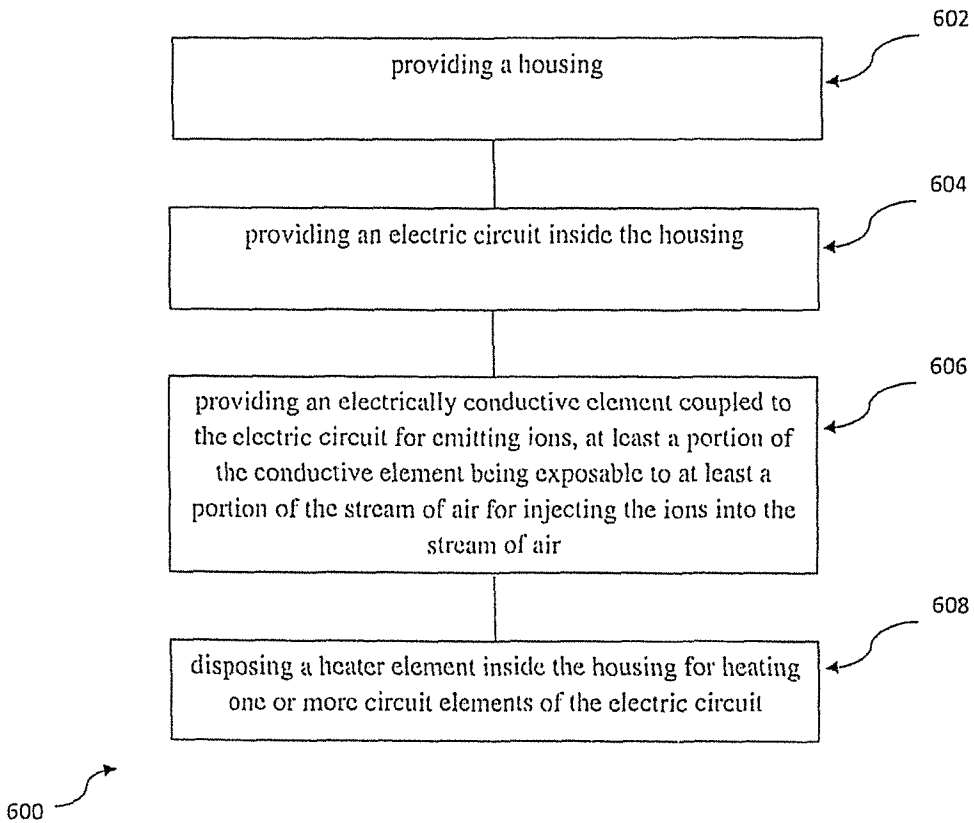
FIG. 6 shows a flow-chart illustrating a method of injecting ions into a stream of air according to one embodiment.

FIG. 6 shows a flow-chart 600 illustrating a method of injecting ions into a stream of air according to one embodiment. At step 602, a housing is provided. At step 604, an electric circuit is provided inside the housing. At step 606, an electrically conductive element coupled to the electric circuit is provided for emitting ions, at least a portion of the conductive element being exposable to at least a portion of the stream of air for injecting the ions into the stream of air. At step 608, a heater element is disposed inside the housing for heating one or more circuit elements of the electric circuit.

The method may further comprise disposing a temperature sensor inside the housing, the temperature sensor being configuring for sensing a temperature at or near the one or more circuit elements. The method may comprise providing a feedback circuit for controlling the heater element responsive to the temperature sensed by the temperature sensor.

The housing may be configured to define a channel for the stream of air. The housing may be substantially ring-shaped, wherein the channel is provided by a hollow center portion of the substantially ring-shaped housing. The method may comprise disposing the portion of the conductive element inside a chamber of the housing adjacent the channel for injecting the ions into the stream of air. The chamber may comprise an opening for exposure of the portion of the conductive element to the portion of the stream of air.

The one or more circuit elements may comprise a piezo-transformer. The method may comprise disposing the heating element in a stacked arrangement with the piezo-transformer.

The method may further comprise coupling the housing to an airflow device for generating the stream of air. The housing may be adjustably coupled to the airflow device.

The method may comprise coupling the electrically conductive element to the electric circuit for emitting negative ions.

The housing may be configured to be thermally insulating, such as by choice of one or more of material(s), coating and/or lining layer(s).

It will be appreciated by a person skilled in the art that numerous variations and/or modifications may be made to the present invention as shown in the specific embodiments without departing from the spirit or scope of the invention as broadly described. The present embodiments are, therefore, to be considered in all respects to be illustrative and not restrictive. Also, the invention includes any combination of features, in particular any combination of features in the patent claims, even if the feature or combination of features is not explicitly specified in the patent claims or the present embodiments.

While the device, in particular the housing, has been shown with a particular shape and relative dimensions in the example embodiments described, it will be appreciated that the device can have other shapes and/or dimensions in different embodiments.

Also, white the example applications show the device being used for external coupling to an air flow device, the device may be disposed inside an air flow device.

Furthermore, while an air-conditioning unit has been described in the example applications, the device used with different air flow devices.

Also, while control of the operating temperature of the piezo transformer has been described in the example embodiments, the operating temperature of one or more other components may alternatively or additionally be controlled in different embodiments.

What is claimed is:

1. A device for injecting ions into a stream of air, comprising:

a housing;

an electric circuit inside the housing and having a piezo transformer;

an electrically conductive element coupled to the electric circuit for emitting ions, at least a portion of the conductive element being exposable to at least a portion of the stream of air for injecting the ions into the stream of air; and heater element disposed inside the housing near the piezo transformer in the electric circuit and thermally coupled to the piezo transformer to control the temperature of the piezo transformer.

2. The device of claim 1, further comprising a temperature sensor disposed inside the housing and configured for sensing a temperature at or near the piezo transformer.

3. The device of claim 2, comprising a feedback circuit for controlling the heater element responsive to the temperature sensed by the temperature sensor.

4. The device of any one of the preceding claims, wherein the housing is configured to define a channel for the stream of air.

5. The device of claim 4, wherein the housing is substantially ring-shaped, wherein the channel is provided by a hollow center portion of the substantially ring-shaped housing.

6. The device of claim 4, wherein the piezo transformer is disposed inside a chamber of the housing adjacent the channel for injecting the ions into the stream of air.

7. The device of claim 6, wherein the chamber comprises an opening for exposure of the portion of the piezo transformer to the portion of the stream of air.

8. The device of claim 1, further comprising a coupling element for coupling the device to an airflow device for generating the stream of air.

9. The device of claim 8, wherein the coupling element is configured for adjustably coupling the device to the airflow device.

10. The device of claim 1, wherein piezo transformer is coupled to the electric circuit for emitting negative ions.

11. The device of claim 1, wherein the housing is configured to be thermally insulating, such as by choice of one or more of material(s), coating and/or lining layer(s).

12. The device of claim 1, wherein the heater element is disposed in a stacked arrangement with the piezo-transformer.

13. A method of injecting ions into a stream of air, comprising:

providing a housing;

providing an electric circuit with a piezo transformer inside the housing;

providing an electrically conductive element coupled to the electric circuit for emitting ions, at least a portion of the conductive element being exposable to at least a portion of the stream of air for injecting the ions into the stream of air; and disposing a heater element inside the housing near the piezo transformer in the electric circuit and thermally coupled to the piezo transformer to control the temperature of the piezo transformer.

14. The method of claim 13, further comprising disposing a temperature sensor inside the housing, the temperature sensor being configuring for sensing a temperature at or near the piezo transformer.

15. The method of claim 14, comprising providing a feedback circuit for controlling the heater element responsive to the temperature sensed by the temperature sensor.

16. The method of claim 13, wherein the housing is configured to define a channel for the stream of air.

17. The method of claim 16, wherein the housing is substantially ring-shaped, wherein the channel is provided by a hollow center portion of the substantially ring-shaped housing.

18. The method of claim 16, comprising disposing the piezo transformer inside a chamber of the housing adjacent the channel for injecting the ions into the stream of air.

19. The method of claim 18, wherein the chamber comprises an opening for exposure of the piezo transformer to the portion of the stream of air.

20. The method of claim 13, comprising disposing the heating element in a stacked arrangement with the piezo-transformer.

21. The method of claim 13, further comprising coupling the housing to an airflow device for generating the stream of air.

22. The method of claim 21, wherein the housing is adjustably coupled to the airflow device.

23. The method of claim 13, comprising coupling the piezo transformer to the electric circuit for emitting negative ions.

24. The method of claim 13, wherein the housing is configured to be thermally insulating, such as by choice of one or more of material(s), coating and/or lining layer(s).

* * * * *